US006752000B2

(12) United States Patent
Reynolds et al.

(10) Patent No.: US 6,752,000 B2
(45) Date of Patent: Jun. 22, 2004

(54) SINGLE CAM CONTAINER NECKING APPARATUS AND METHOD

(75) Inventors: William Storrs Reynolds, Lynchburg, VA (US); Joseph G. Schill, Lynchburg, VA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/305,169

(22) Filed: Nov. 27, 2002

(65) Prior Publication Data

US 2004/0099036 A1 May 27, 2004

(51) Int. Cl.[7] ..... B21D 41/04
(52) U.S. Cl. ..... 72/352; 413/69
(58) Field of Search ..... 72/352, 379.4; 413/69

(56) References Cited

U.S. PATENT DOCUMENTS 3,812,696 A * 5/1974 Kneusel et al. ..... 72/379.4
4,392,764 A * 7/1983 Kubis et al. ..... 413/69
4,457,158 A * 7/1984 Miller et al. ..... 413/69
5,249,449 A 10/1993 Lee et al.
6,167,743 B1 1/2001 Marritt et al.

* cited by examiner

*Primary Examiner*—Lowell A. Larson
(74) *Attorney, Agent, or Firm*—Foley & Lardner LLP

(57) ABSTRACT

The present invention includes a knockout ram assembly for necking a container comprising an anti-rotation device adapted to prevent a piston/pilot assembly from rotating while bolting or unbolting the pilot. The present invention also includes a method of replacing a knockout ram assembly from a container necking apparatus comprising unbolting from the container necking apparatus a first knockout ram assembly having an anti-rotation device adapted to substantially prevent the piston/pilot assembly from rotating, removing the first knockout ram assembly from the container necking apparatus, and bolting to the container necking apparatus a second knockout ram assembly having an anti-rotation device adapted to substantially prevent the piston/pilot assembly from rotating.

21 Claims, 5 Drawing Sheets

SINGLE CAM CONTAINER NECKING APPARATUS AND METHOD

BACKGROUND OF THE INVENTION

The present invention relates to the field of container necking apparatus and methods used in the tapered reduction of the diameter of the top portion of beverage and other type of containers. More specifically, the invention relates to a new and improved, simplified and less expensive necking apparatus and method providing enhanced functional results for necking containers such as beverage containers in which only one cam is employed for actuating and driving the tooling to effect the necking function.

A variety of prior art methods and devices have been employed for necking containers. The known prior art devices employ a cylindrical necking die which is reciprocated axially to engage the exterior of the upper end of a container workpiece and a coaxial die pilot, also known as a "knockout" or "pilot," which simultaneously moves axially in a mating manner into the open end of the container workpiece. The aforementioned prior art devices have employed a variety of complicated and expensive drive arrangements including a first cam for driving the necking die and a second cam for driving the pilot die.

While many of the prior devices have provided satisfactory results and have been capable of operating at progressively higher speeds during the recent years, such devices have been increasingly complex in construction and have been extremely expensive to manufacture and maintain.

For example, Lee et al. U.S. Pat. No. 5,249,449 discloses a can necking apparatus of complex construction in which a necking die and a pilot are reciprocated in unison into contact with a can body that is pressured with air. The pilot and the necking die are capable of axial movement relative to each other and forward movement of the pilot is terminated by engagement of flange with a bumper ring as shown on the left end of FIG. 1 of the Lee et al. patent. However, the necking die continues forward movement after forward movement of the pilot has been terminated. Thus, substantial vibration and noise as well as complexity of construction render the device of this patent to be expensive to construct and maintain. The device of the Lee patent is additionally deficient in that it is incapable of operating at high speeds comparable to other conventional necking devices.

Similarly, Miller et al. U.S. Pat. No. 4,457,158 is directed to a can necking apparatus employing a complex mechanically driven structure for effecting container necking by moving a die member and a pilot forwardly into the open end of a container workpiece. The pilot has its forward travel terminated by engagement of its surfaces and with surfaces with of the base of the apparatus. Here again, noise and vibration are substantial problems which limit the speed of operation and reliability of the device.

More recently, Marritt et al. U.S. Pat. No. 6,167,743, the contents of which are hereby incorporated by reference, disclosed an improved necking apparatus having a knockout ram assembly 18 with only a single cam for operating the necking tooling (see FIG. 7). The apparatus uses a floating piston 34 having an axial bore 37. Air supplied to the back of the piston both urges the piston 34 forward and flows through the axial bore 37 to help seat and pressurize the can during necking. Although simpler and more reliable than previous necking apparatus, converting a necking turret to use the knockout ram assembly 18 proved difficult in practice, requiring roughly a full day to accomplish.

Therefore, it would be advantageous to provide a simple, reliable knockout ram assembly which can be easily and more quickly replaced than conventional knockout ram assemblies.

SUMMARY OF THE INVENTION

One embodiment of the present invention includes a knockout ram assembly for necking a container comprising an anti-rotation device adapted to prevent a piston/pilot assembly from rotating while bolting or unbolting the knockout ram assembly from a container necking apparatus.

In another embodiment of the invention, the anti-rotation device comprises a hollow cylinder adapted to fit in registration with two flats on a shaft of a pilot.

In another embodiment of the invention, the anti-rotation device includes at least one roll pin.

A further embodiment of the present invention includes a method of replacing a knockout ram assembly from a container necking apparatus comprising unbolting from the container necking apparatus a first knockout ram assembly having an anti-rotation device adapted to substantially prevent the piston/pilot assembly from rotating; removing the first knockout ram assembly from the container necking apparatus; and bolting to the container necking apparatus a second knockout ram assembly having an anti-rotation device adapted to substantially prevent the piston/pilot assembly from rotating.

A further embodiment of the present invention includes a knockout ram assembly for necking a container comprising a floating piston/pilot assembly including a pilot having a front, a back and at least one through hole connecting the front and back and a piston having a front and back, said piston and pilot oriented such that front of the piston faces the back of the pilot; a necking die; a pressurized air input conduit; a first pressurized air delivery conduit configured to deliver pressurized air to the back of the piston; and a second pressurized air delivery conduit configured to supply air through the pilot into the container, wherein pressurized air from the pressurized air input conduit substantially simultaneously forces the floating piston/pilot assembly forward via the first pressurized air delivery conduit and charges the container with pressurized air via the second pressurized air delivery conduit.

In another embodiment of the invention, the container receives sufficient air volume to hold the container rigid during necking.

In another embodiment of the invention, the piston/pilot assembly receives sufficient air pressure to hold said piston/pilot assembly fully forward to maintain pilot interface for neck support while necking the container.

In another embodiment of the invention, the assembly is adapted so that the container seals in the necking die and when the container seals in the necking die, the air flow decreases in the container causing the air pressure in the assembly to equalize.

In another embodiment of the invention, the knockout ram assembly further comprises an adjustable travel delimeter to ensure sufficient neck support is maintained during necking.

In another embodiment of the invention, the knockout ram assembly further comprises an anti-rotation device.

In another embodiment of the invention, the anti-rotation device has a cross section selected from the group consisting of truncated circular, elliptical and hexagonal.

A further embodiment of the invention includes a knockout ram assembly for necking a container comprising: a pilot/piston assembly including a pilot and a piston, wherein the piston and the pilot are adapted such that the piston diameter is essentially equal to the pilot diameter for each stage of necking.

In another embodiment of the invention, the knockout ram assembly further comprises at least one piston sleeve.

In another embodiment of the invention, air pressure in the container can equalize with air pressure on the piston for each stage of necking.

A further embodiment of the invention includes a method of necking a container comprising supplying a container to a necking machine having a knockout ram assembly having, a floating piston/pilot assembly including a pilot having a front, a back and at least one through hole connecting the front and back and a piston having a front and back, said piston and pilot joined such that front of the piston is connected to the back of the pilot, a necking die, a pressurized air input conduit, a first pressurized air delivery conduit configured to deliver pressurized air to the back of the piston, and a second pressurized air delivery conduit configured to supply air through the pilot into the inside of the container; supplying pressurized air from the pressurized air input source substantially simultaneously to the floating piston/pilot assembly via the first pressurized air conduit to force the floating piston/pilot assembly forward and to the container via the second pressurized air delivery conduit to charge the container with pressurized air; forcing the floating piston/pilot assembly forward; and charging the container with pressurized air.

In another embodiment of the invention, the step of supplying pressurized air supplies the container with sufficient air volume to hold the container rigid during necking.

In another embodiment of the invention, the step of supplying pressurized air supplies the piston/pilot assembly with sufficient air pressure to hold said piston/pilot assembly fully forward to maintain pilot interface for neck support while necking the container.

In another embodiment of the invention, the step of forcing the floating piston/pilot assembly forward comprises forming a seal between the container and the necking die.

In another embodiment of the invention, the step of forcing the floating piston/pilot assembly forward further comprises decreasing air flow to the container and equalizing air pressure in the assembly after forming the seal.

In another embodiment of the invention, the method further comprises the step of substantially preventing the piston/pilot assembly from rotating.

A further embodiment of the present invention includes container necking apparatus comprising a knockout ram assembly as disclosed above.

BRIEF DESCRIPTION OF THE DRAWINGS

The invention will be better understood by reading the following detailed description of the preferred, but not sole, embodiment of the invention with reference to the accompanying drawing figures in which like reference numerals refer to like elements throughout, and in which.

DETAILED DESCRIPTION OF THE PREFERRED EMBODIMENTS

The present inventors have discovered that it is possible to make a knockout ram assembly for a container necking apparatus which can be more easily and quickly replaced than the knockout ram assemblies currently in use. This is accomplished by providing the knockout ram assembly with an anti-rotation device. With this device, replacing the knockout ram assembly is significantly easier and faster. Thus, the knockout ram assembly according to the various embodiments of the present invention can often be replaced in minutes rather than the full day typical of prior art knockout ram assemblies.

In addition to the anti-rotation device, one embodiment of the invention includes two pressurized air delivery conduits which substantially simultaneously supply pressurized air to (1) force a floating piston/pilot assembly forward and (2) pressurize the container. More particularly, the first pressurized air delivery conduit is configured so that pressurized air is delivered to the back of the piston of a piston/pilot assembly while the second pressurized air delivery conduit is configured so that pressurized air is delivered to the inside of the container. This embodiment provides a direct replacement for knockout ram assemblies currently in use in the field. That is, the knockout ram assembly according to this embodiment can replace existing knockout ram assemblies on existing necking apparatus without the purchase of a new turret or ancillary parts.

Figure 2:
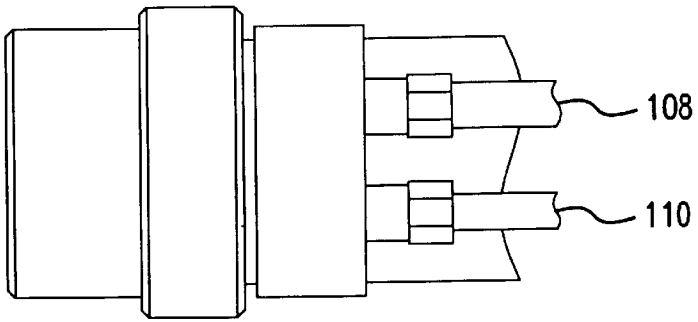
FIG. 2 is a partial top view of the knockout ram assembly of FIG. 1.
Figure 1:
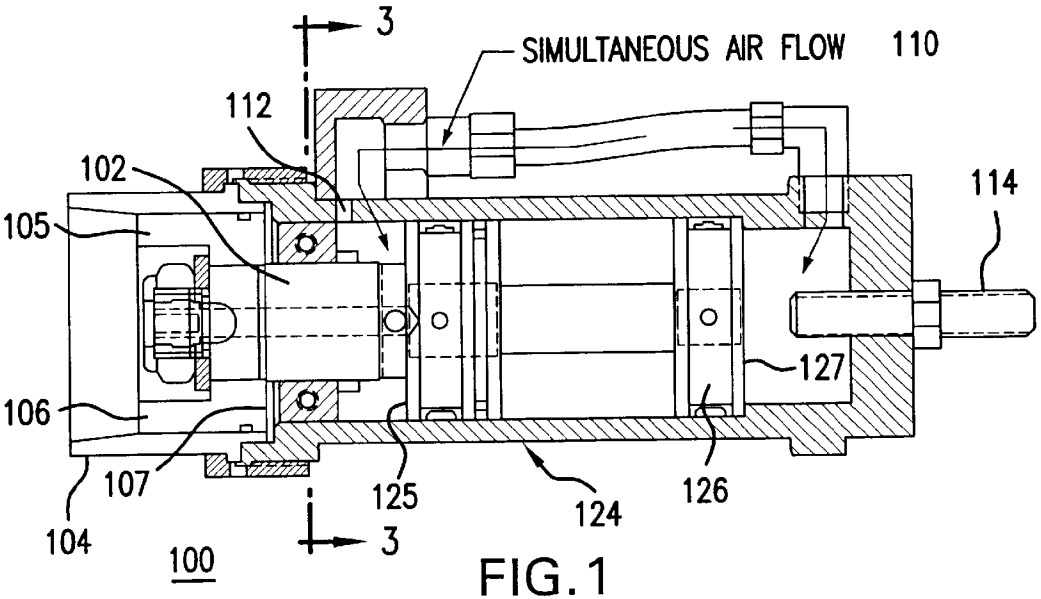
FIG. 1 is a schematic side view of a knockout ram assembly according to a first embodiment of the invention.
Figure 3:
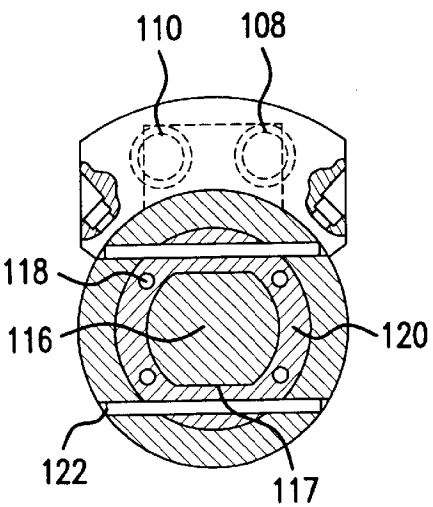
FIG. 3 is a cross-sectional view of the knockout ram assembly of FIG. 1 taken along section line 3—3.
Figure 7:
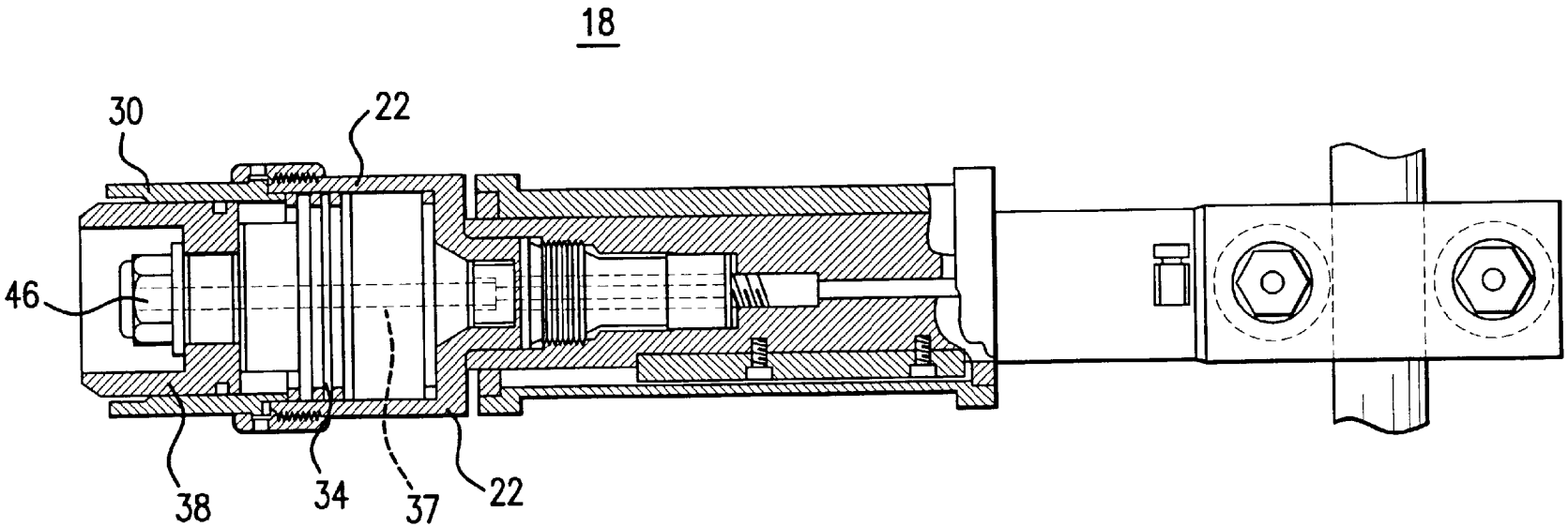
FIG. 7 is a schematic side view of a prior art knockout ram assembly.

FIGS. 1–3 illustrate a first embodiment of the invention. This embodiment includes an anti-rotation device 120 in the knockout ram assembly 100. The anti-rotation device 120 prevents the piston/pilot assembly 102 from rotating as it is bolted (or unbolted) from the necking apparatus. In contrast, to remove the prior art knockout ram assembly 18 (FIG. 7), it is necessary to first pull the necking die 30 forward approximately ⅜ inches to expose a gap between the piston 34 and the housing 22. It is then necessary to wedge flat wrenches into the gap to keep the pilot/piston assembly 38/34 from rotating while removing (rotating) nut 46.

In the preferred configuration of the anti-rotation device 120, a shaft 116 of the piston/pilot assembly 102 has two flats 117 which fit in registration with the hollow core of a cylinder shaped anti-rotation device 120. Additionally, the anti-rotation device 120 preferably includes two roll pins 122. The roll pins 122 extend through the housing 124 and improve the anti-rotation properties of the anti-rotation device 120.

Additionally, this embodiment of the invention includes features which allow the knockout ram assembly 100 to replace conventional knockout ram assemblies 18 (FIG. 7) without requiring a new turret or the addition of extra parts. In this embodiment the knockout ram assembly 100 includes a floating piston/pilot assembly 102. The piston/pilot assembly 102 is so known because the forward motion of the pilot 106 stops when the pressure of the pressurized air urging the piston/pilot assembly 102 forward is equal to the pressure in the interior of the container. The operation of the piston/pilot assembly 102 is discussed in more detail below.

The piston/pilot assembly 102 includes a pilot 106 having a front 105, a back 107 and at least one through hole 118 connecting the front 105 and back 107. The piston/pilot assembly 102 also includes a piston 126 having a front 125 and back 127. In the preferred embodiment of the invention, the piston 126 and pilot 106 are joined such that front 125 of the piston 126 is connected to the back 107 of the pilot 106. The piston 126 and pilot 106 may be joined by any method known in the art. Example joining methods include, but are not limited to, bolting, screwing, and adhesive bonding. Additionally, the piston 126 and pilot 106 may be formed integrally or even loaded in housing 124 without actually joining.

The piston/pilot assembly 102 also includes a necking die 104 and a pressurized air input conduit 108 (FIG. 2). Pressurized air is supplied to the pilot/piston assembly 102 from a pressurized air source (not shown) via the pressurized air input conduit 108. The pressurized input air is then supplied simultaneously to a first pressurized air delivery conduit 110 configured to deliver pressurized air to the back 127 of the piston 126 and a second pressurized air delivery conduit 112 configured to supply air to the inside of the can. Note, for the purposes of this disclosure, conduit is defined as any passage or opening suitable for allowing the delivery of air.

Included in the anti-rotation device 120 is at least one through passage 118. Through passages 118 insure that air flow is maintained between the anti-rotation device 120 and the piston/pilot assembly 102. Trapped air would cause a sluggish response of the piston/pilot assembly 102 in housing 124. Pressurized air from the pressurized air input conduit 108 simultaneously forces the floating piston/pilot assembly 102 forward via the first pressurized air delivery conduit 110 and charges the container (located in necking die 104) with pressurized air via the second pressurized air conduit 112 and through a port in the center of the piston/pilot assembly 102. In this manner, the container receives adequate air volume to hold the can rigid during necking and the pilot/piston assembly 102 receives adequate air pressure to hold it fully forward in order to maintain pilot interface for neck support while necking the container. When the container seals in the necking die 104, the airflow decreases in the container and the air pressure in the air system equalizes. At this point, the container is able to push the pilot/piston assembly 102 as originally designed.

With the use of two pressurized air delivery conduits 110, 112, it is possible to substantially simultaneously supply pressurized air to both advance the piston 126 toward the container and to pressurize the container. This arrangement eliminates the mechanical parts associated with mechanical knockout rams. Further, the elimination of the bore through the piston of the prior art floating piston/pilot assembly in combination with the anti-rotation 120 device results in a knockout ram assembly 100 which is both quick and easy to replace and can replace existing knockout ram assemblies without the purchase of ancillary parts.

In addition to having two pressurized air delivery conduits 110, 112, the preferred embodiment of the invention includes several additional features. For example, the preferred embodiment includes an adjustable travel delimeter 114. The adjustable travel delimeter 114 limits the travel of the piston/pilot assembly 102 in the event that the mechanical interface between the container inner diameter and the pilot outer diameter pushes the pilot/piston assembly 102 too far forward during the necking process. The adjustable travel delimeter 114 ensures that adequate neck support is maintained during the necking process.

Figure 4:
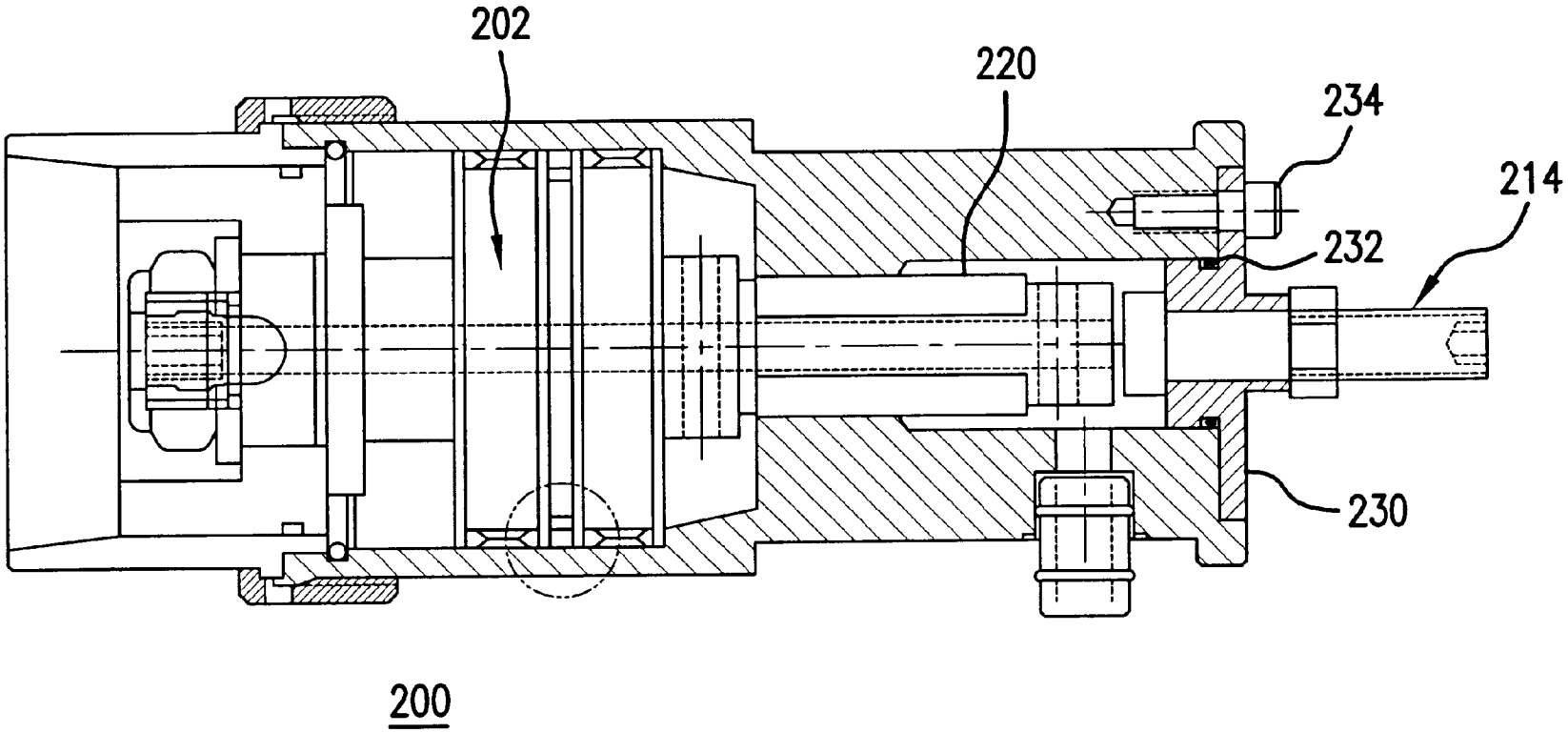
FIG. 4 is a schematic side view of a knockout ram assembly according to another embodiment of the invention.

FIG. 4 illustrates a second embodiment of the invention comprising a second adjustable travel delimeter 214. In contrast with the first embodiment of the invention, this embodiment does not have two pressurized air delivery conduits 110, 112. However, in this embodiment, the knockout ram assembly 200 includes a floating pilot/piston assembly 202 and an anti-rotation device 220. As in the first embodiment, the adjustable travel delimeter 214 limits the travel of the floating piston/pilot assembly 202 in the event that the mechanical interface between the container inner diameter and the pilot outer diameter pushes the floating pilot/piston assembly 202 too far forward during the necking process. Further, this embodiment includes a removable back plate 230 which is secured via bolt 234 and seal 232. The removable back plate 230 allows for easy inspection and repair of the anti-rotation device 220.

Figure 5A:
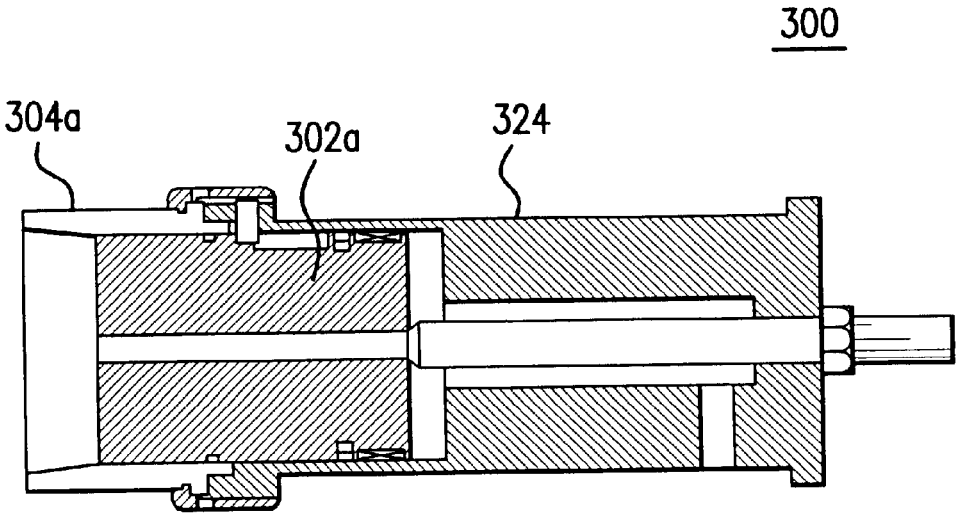
FIG. 5*a* is a schematic side view of a knockout ram assembly according a third embodiment of the invention.
Figure 5B:
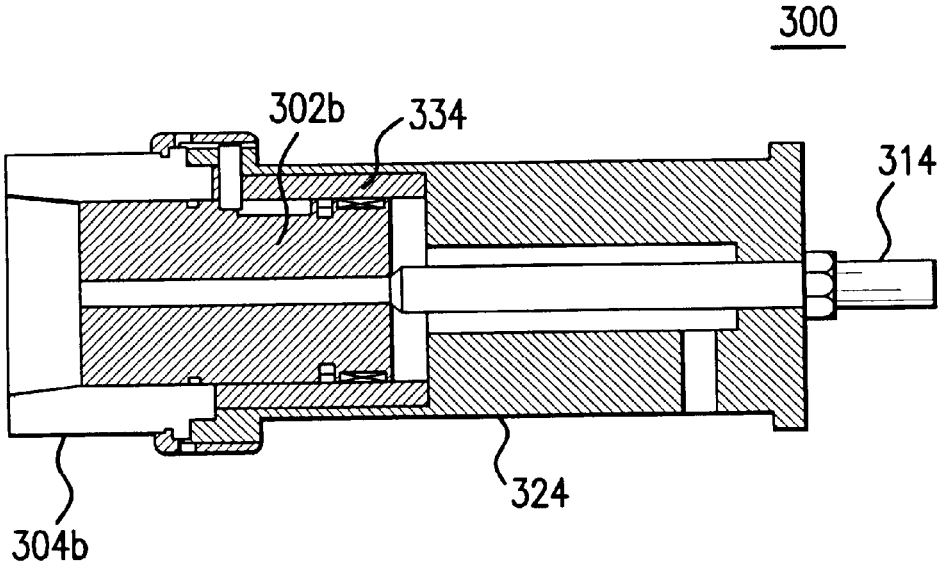
FIG. 5*b* is a schematic side view of a knockout ram assembly according a third embodiment of the invention illustrating the use of a piston sleeve.

FIGS. 5*a* and 5*b* illustrate still another embodiment of the invention. FIG. 5*a* illustrates a knockout ram assembly 300 configured for an initial necking operation. The knockout ram assembly 300 has a relatively narrow necking die 304*a* and a correspondingly wide piston/pilot assembly 302*a*. FIG. 5*b* illustrates knockout ram assembly 300 set for a later necking operation. The knockout ram assembly 300 has a relatively wide necking die 304*b* and a correspondingly narrow piston/pilot assembly 302*b*.

In this embodiment of the invention, a piston diameter is designed to match a pilot diameter for each stage of necking. This feature allows the air pressure to equalize on each side of the piston/pilot assembly 302 for the full range of diameters encountered during the necking process. Matching diameters ensures that force differentials induced by air pressure will not cause unwanted relative movement of mechanical parts.

As the piston/pilot assembly 302*a*, 302*b* becomes smaller, a piston sleeve 334 can be inserted into the housing 324 to compensate for the reduced diameters. Preferably, the embodiment illustrated in FIGS. 5*a* and 5*b* also includes an adjustable travel delimeter 314.

Figure 6:
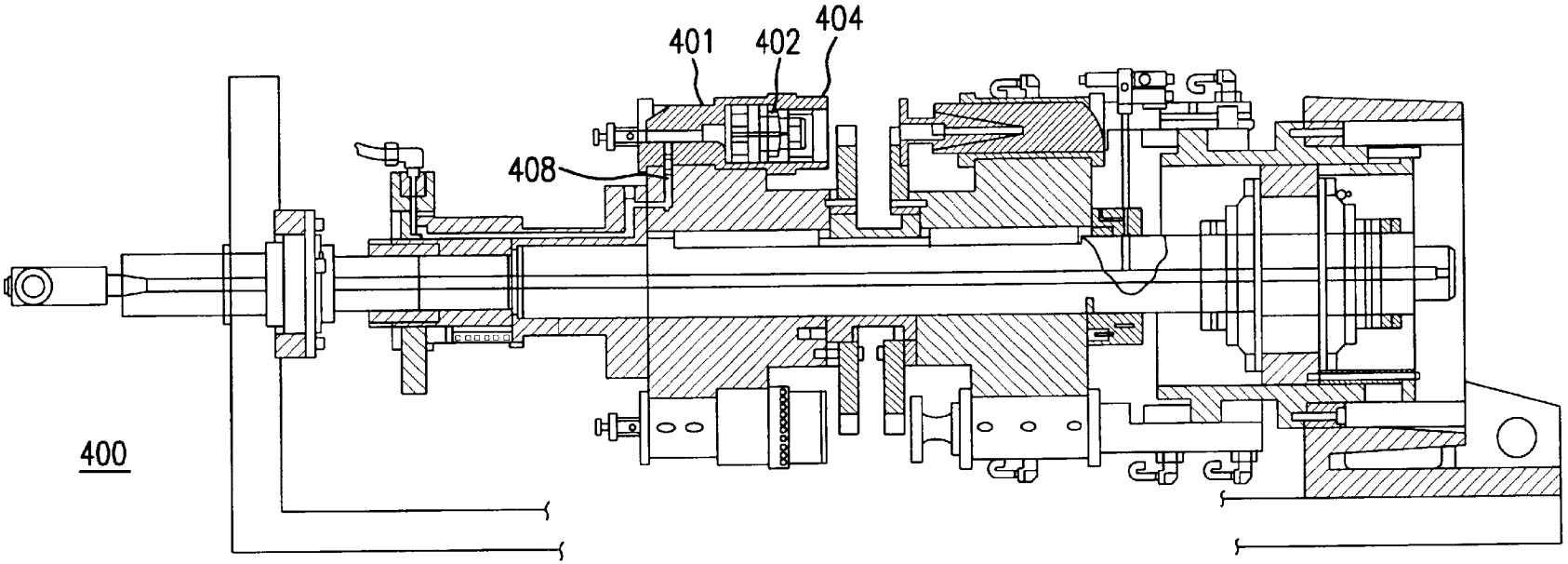
FIG. 6 is a schematic side view of a necking apparatus incorporating a knockout ram assembly of the invention.

FIG. 6 illustrates another embodiment of the invention. This embodiment is a necking apparatus 400 incorporating a knockout ram assembly 401 according to any of the previously described embodiments. The necking apparatus 400 according to this embodiment of the invention can be easily modified. That is, the knockout ram assembly 401, incorporating a floating piston/pilot assembly 402 and the appropriate necking die 404, can be easily and quickly replaced. Therefore, a necking apparatus 400 according to this embodiment of the invention is idle for less time while undergoing modification and consequently has greater availability for production.

The foregoing description of the invention has been presented for purposes of illustration and description. It is not intended to be exhaustive or to limit the invention to the precise form disclosed, and modifications and variations are possible in light of the above teachings or may be acquired from practice of the invention. The drawings and description were chosen in order to explain the principles of the invention and its practical application. It is intended that the scope of the invention be defined by the claims appended hereto, and their equivalents.

What is claimed is:

1. A knockout ram assembly for necking a container comprising an anti-rotation device adapted to prevent a piston/pilot assembly from rotating while bolting or unbolting the piston/pilot assembly from a container necking apparatus, wherein the anti-rotation device does not require the insertion of a tool while bolting or unbolting the piston/pilot assembly to prevent the piston/pilot assembly from rotating.

2. The knockout ram assembly of claim 1, wherein the anti-rotation device comprises a hollow cylinder adapted to fit in registration with two flats on a shaft of a pilot.

3. The knockout ram assembly of claim 2, wherein the anti-rotation device includes at least one roll pin.

4. A method of replacing a piston/pilot assembly from a container necking apparatus comprising:

unbolting from the container necking apparatus a first piston/pilot assembly having an anti-rotation device adapted to substantially prevent the piston/pilot assembly from rotating;

removing the first piston/pilot assembly from the container necking apparatus; and bolting to the container necking apparatus a second piston/pilot assembly having an anti-rotation device adapted to substantially prevent the piston/pilot assembly from rotating, wherein the anti-rotation device does not require the insertion of a tool while bolting or unbolting the piston/pilot assembly to prevent the piston/pilot assembly from rotating.

5. A knockout ram assembly for necking a container comprising:

a floating piston/pilot assembly including a pilot having a front, a back and at least one through hole connecting the front and back and a piston having a front and back, said piston and pilot oriented such that front of the piston faces the back of the pilot;

a necking die;

a pressurized air input conduit;

a first pressurized air delivery conduit configured to deliver pressurized air to the back of the piston; and a second pressurized air delivery conduit configured to supply air through the pilot into the container, wherein pressurized air from the pressurized air input conduit substantially simultaneously forces the floating piston/pilot assembly forward via the first pressurized air delivery conduit and charges the container with pressurized air via the second pressurized air delivery conduit.

6. The knockout ram assembly of claim 5, wherein the container receives sufficient air volume to hold the container rigid during necking.

7. The knockout ram assembly of claim 6, wherein the piston/pilot assembly receives sufficient air pressure to hold said piston/pilot assembly fully forward to maintain pilot interface for neck support while necking the container.

8. The knockout ram assembly of claim 5, wherein the assembly is adapted so that the container seals in the necking die and when the container seals in the necking die, the air flow decreases in the container causing the air pressure in the assembly to equalize.

9. The knockout ram assembly of claim 5, further comprising an adjustable travel delimeter to ensure sufficient neck support is maintained during necking.

10. The knockout ram assembly of claim 5, further comprising an anti-rotation device.

11. The knockout ram assembly of claim 10, wherein the anti-rotation device has a cross section selected from the group consisting of truncated circular, elliptical and hexagonal.

12. A knockout ram assembly for necking a container comprising:

a pilot/piston assembly including a pilot and a piston, wherein the piston and the pilot are adapted such that the piston diameter is essentially equal to the pilot diameter for each stage of necking.

13. The knockout ram assembly of claim 12, further comprising at least one piston sleeve.

14. The knockout ram assembly of claim 12, wherein air pressure in the container can equalize with air pressure on the piston for each stage of necking.

15. A method of necking a container comprising: supplying a container to a necking machine having a knockout ram assembly having, a floating piston/pilot assembly including a pilot having a front, a back and at least one through hole connecting the front and back and a piston having a front and back, said piston and pilot joined such that front of the piston is connected to the back of the pilot, a necking die, a pressurized air input conduit, a first pressurized air delivery conduit configured to deliver pressurized air to the back of the piston, and a second pressurized air delivery conduit configured to supply air through the pilot into the inside of the container;

supplying pressurized air from the pressurized air input source substantially simultaneously to the floating piston/pilot assembly via the first pressurized air conduit to force the floating piston/pilot assembly forward and to the container via the second pressurized air delivery conduit to charge the container with pressurized air;

forcing the floating piston/pilot assembly forward; and charging the container with pressurized air.

16. The method of claim 15, wherein the step of supplying pressurized air supplies the container with sufficient air volume to hold the container rigid during necking.

17. The method of claim 16, wherein the step of supplying pressurized air supplies the piston/pilot assembly with sufficient air pressure to hold said piston/pilot assembly fully forward to maintain pilot interface for neck support while necking the container.

18. The method of claim 15, wherein the step of forcing the floating piston/pilot assembly forward comprises forming a seal between the container and the necking die.

19. The method of claim 18, wherein the step of forcing the floating piston/pilot assembly forward further comprises decreasing air flow to the container and equalizing air pressure in the assembly after forming the seal.

20. The method of claim 15, further comprising the step of substantially preventing the piston/pilot assembly from rotating.

21. A container necking apparatus comprising the knockout ram assembly of claim 5.

* * * * *